United States Patent [19]

Carrigan et al.

[11] 4,098,058

[45] Jul. 4, 1978

[54] APPARATUS FOR DISPENSING, FILLING AND CAPPING A PLURALITY OF CUPS

[75] Inventors: David B. Carrigan, Hickory Corners; Roy W. Freas, Kalamazoo, both of Mich.

[73] Assignee: David Carrigan and Associates, Inc., Kalamazoo, Mich.

[21] Appl. No.: 700,045

[22] Filed: Jun. 25, 1976

[51] Int. Cl.[2] ..... B65B 7/28; B67B 3/08

[52] U.S. Cl. ..... 53/315; 53/281; 53/314; 141/238; 221/277

[58] Field of Search ..... 53/281, 282, 314, 316, 53/313, 315; 221/277

[56] References Cited

U.S. PATENT DOCUMENTS

| | | | |
|---|---|---|---|
| 2,319,213 | 5/1943 | Davies | 53/316 X |
| 2,347,668 | 5/1944 | Davies | 53/313 X |
| 2,352,761 | 7/1944 | Bell | 53/314 X |
| 2,805,532 | 9/1957 | Anderson | 53/314 |
| 2,954,948 | 10/1960 | Johnson | 221/277 X |
| 3,137,982 | 6/1964 | Decker et al. | 53/316 |
| 3,342,010 | 9/1967 | Henry | 53/282 X |
| 3,550,240 | 12/1970 | Bresley et al. | 53/313 X |
| 3,564,812 | 2/1971 | Mueller et al. | 53/282 X |
| 3,694,997 | 10/1972 | Christine et al. | 53/282 X |

*Primary Examiner*—Travis S. McGehee
*Attorney, Agent, or Firm*—Gary, Juettner & Pyle

[57] ABSTRACT

The apparatus herein described is operative to dispense lines and rows of cups into a plurality of spaced receptacles of a tray, whereupon the tray is moved under successive portions of the apparatus or stations in order to add ice, fill and cup each of the cups in an efficient and regular sequence. The cup dispenser includes opposed recessed stripper bars to selectively strip off the lowermost cup in a stack upon operation of an associated slide mechanism. The ice dispenser includes variable volume chambers to permit a predetermined amount of ice to fall into each of the cups. The capper includes inclined chutes presenting a row of caps which catch on the rims of the cups and are pressed down as the tray is pulled through the capping device. The entire apparatus is designed to be easily disassembled for cleaning.

7 Claims, 14 Drawing Figures

58
56
38
60
58
56
52
47
48
40
44
54
46
44
50
40
48
44
48
50
42
44
48
46
34
34
34
32
34

104
114
118
112
111
102
124
120
148
144
140
142
146
100
138
136
132
134
130
108
108
16
30
128
10
128
12
126

APPARATUS FOR DISPENSING, FILLING AND CAPPING A PLURALITY OF CUPS

BACKGROUND OF THE INVENTION

The dispensing of beverages in disposable cups has become widespread. In the case of soft drinks, a quantity of ice is placed in the cup, the cup is filled, and a cap is placed over the filled cup to prevent spillage until the beverage is delivered to a customer for consumption. The cups are normally filled and capped individually, which is a time consuming and laborious process, particularly when a large number of people are to be served within a short period of time.

The following patents illustrate various mechanical cup dispensing and capping apparatus: U.S. Pat. Nos. 1,990,148; 2,718,981; 2,538,185; 3,169,356; 3,283,955; 3,297,201; 3,379,346; 3,420,407; and 3,659,744.

SUMMARY OF THE INVENTION

The present invention provides the combination of a series of individual units that cooperate in a linear sequence to provide a plurality of filled and capped cups disposed in a single tray. A cup dispensing device fills a tray with lines and rows of single cups, which are then filled and capped at successive stations to produce the final commercial product. The various units represent improvements over the prior art in that they may be easily cleaned and adjusted for different numbers and sizes of cups.

DESCRIPTION OF THE PREFERRED EMBODIMENT

Figure 1:
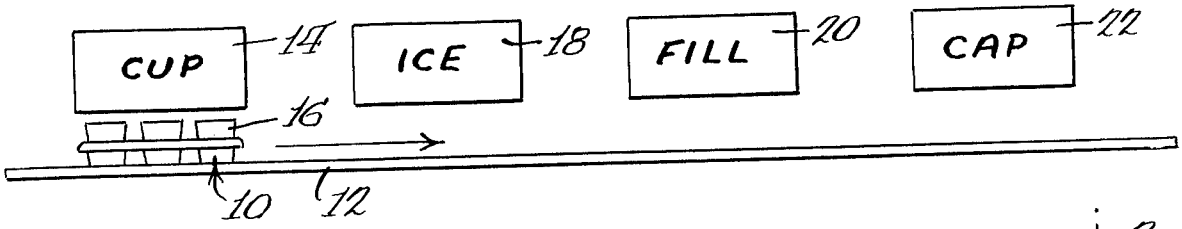
FIG. 1 is a schematic view illustrating the various stages of the apparatus of the present invention.

FIG. 1 is a general representation of the various units and operational stages of the present invention. A tray 10 is supported on a bed 12 to allow movement beneath the various units from left to right as shown. As shown, the bed 12 is a stationary support, although the bed may be replaced with a moving conveyor if desired. The first station comprises a cup dispensing device 14 capable of depositing a plurality of cups 16 in a spaced pattern into pockets of the tray 10. The successive stations comprise an ice dispenser 18 followed by a liquid beverage dispenser 20, each of which fill the tray supported cups simultaneously. Finally, a capping device 22 is provided to cap successive rows of tray-supported cups passing thereunder. It may be seen that the bed 12 extends under each of the successive devices, which are arranged in a straight line resembling a conventional production line. Positive stops (not shown) may be provided to halt the tray 10 in proper position beneath each station.

Figure 2:
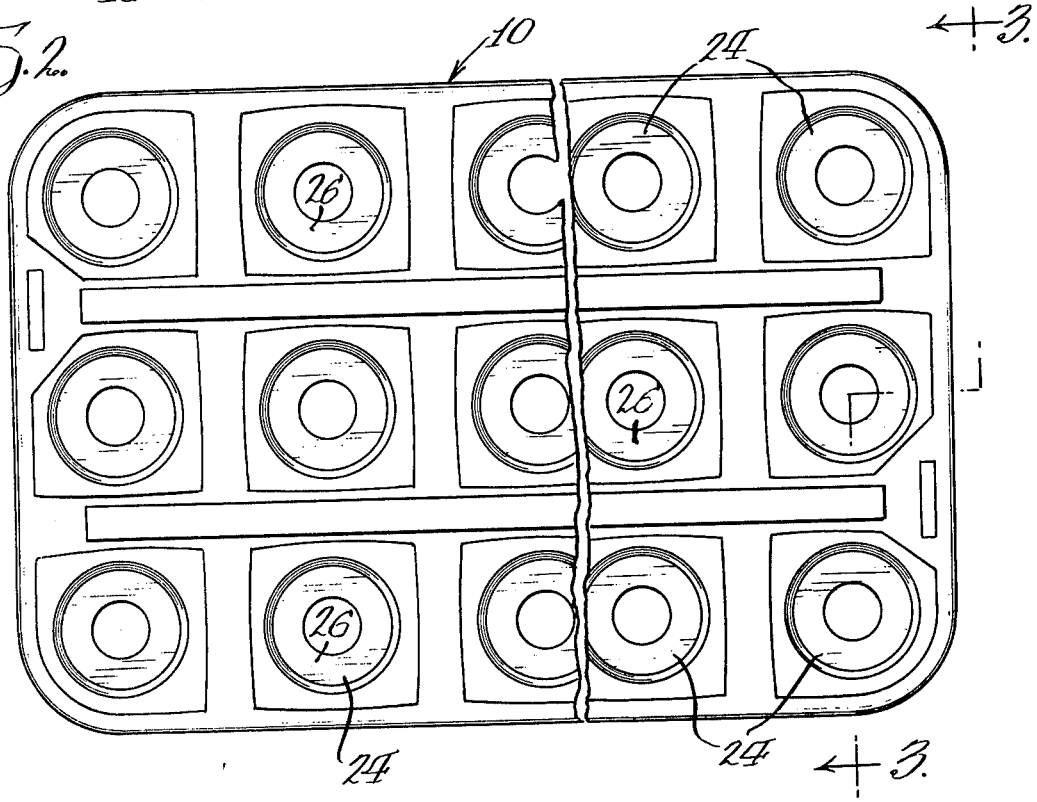
FIG. 2 is a plan view of a tray suitable for use in connection with the present invention.
Figure 3:
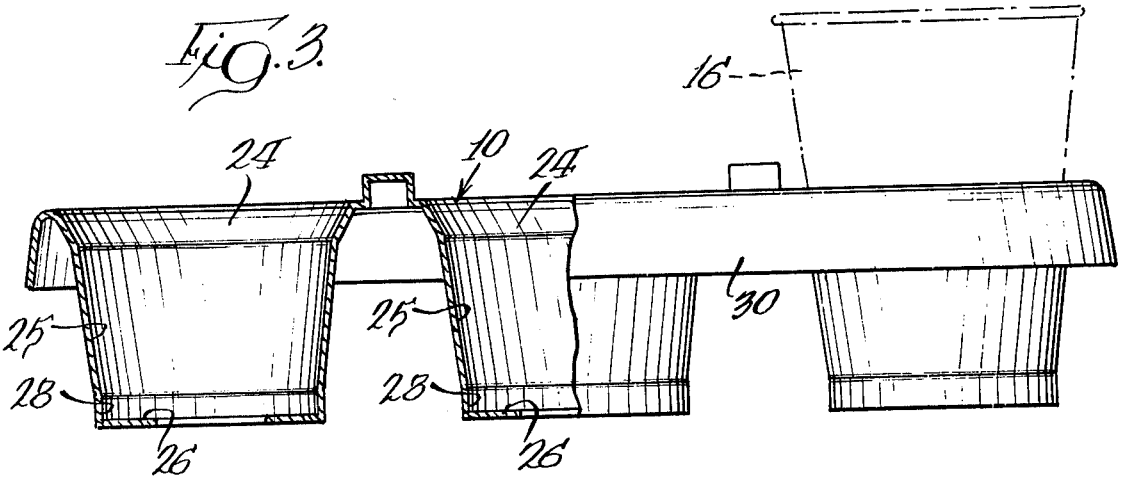
FIG. 3 is a partial sectional view taken along section line 3—3 of FIG. 2.

In order to assure reliable operation of the various units with respect to the cups 16, it is necessary for the tray 10 to hold and maintain the cups in a regular spaced array. A tray 10 suitable for this purpose is shown in FIGS. 2 and 3. The tray 10 is preferably formed of molded polymeric materials and includes a rectangular pattern of a plurality of lines and rows of recessed pockets 24 each in the general shape of a conical section, defined by internal wall 25, corresponding to and conforming with the conical lower portion of the cup 16. The depth of each pocket 24 is sufficient to enclose or surround at least about the lower one-third of the cup, in order to hold the cup firmly and to keep it from tilting from an upright position. In addition, the pockets 24 have flat circular bottom surfaces 26 to support the bottom of the cup. Preferably the bottom portion of the pocket 24 is defined by a conical wall 25, which is faired into a cylindrical lower segment 28 in order to slightly grip the cup near the bottom and hold it steady and level. The tray also has an overturned flange 30 at the periphery to facilitate the moving and carrying of the tray.

The cup dispensing unit 14 is shown in detail in FIGS. 4 through 8. The device shown is capable of accommodating three lines and five rows of cups simultaneously, and a tray 10 having a corresponding number and spacing of pockets would be required to utilize the full capacity of the unit.

Figure 6:
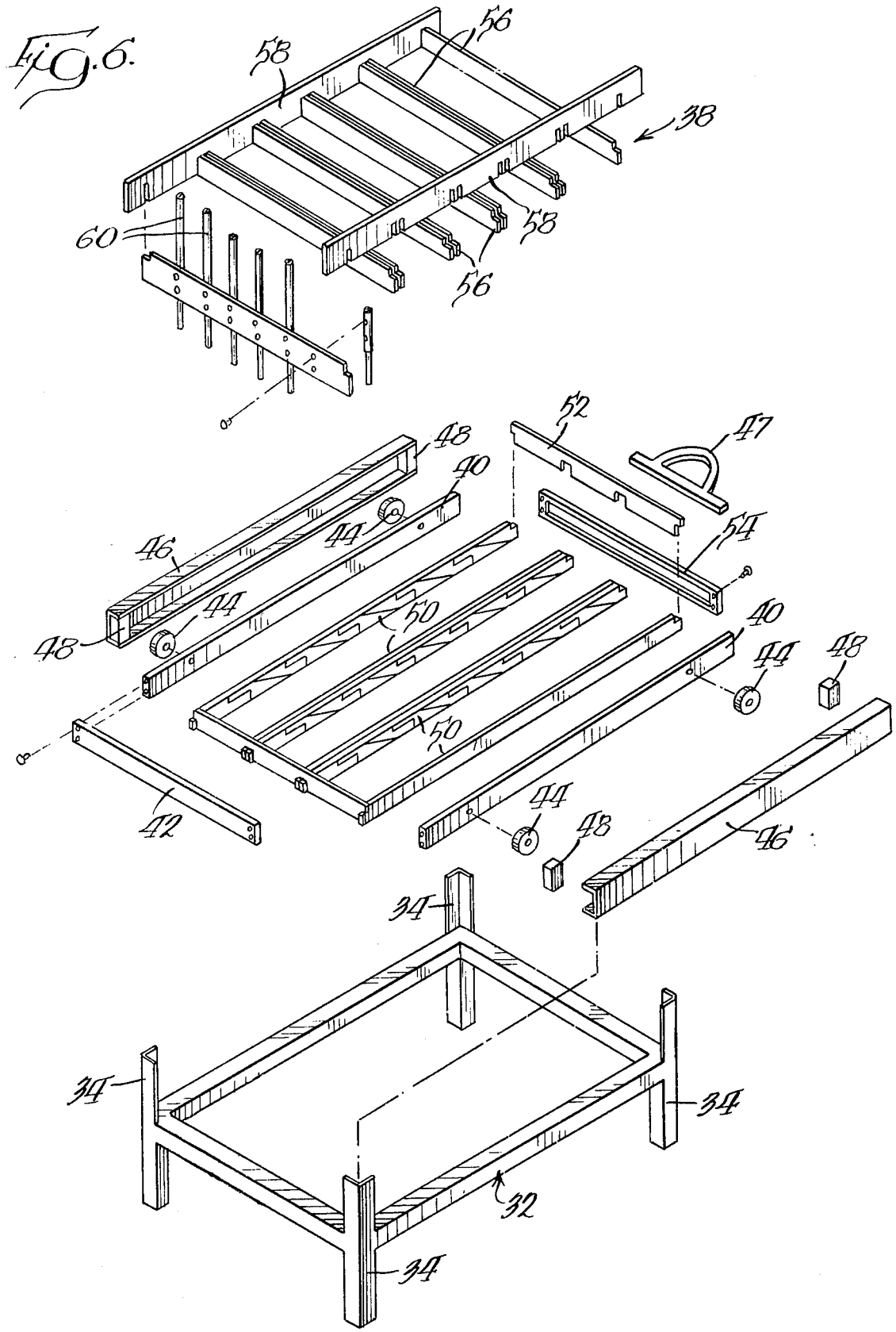
FIG. 6 is an assembly view of the device shown in FIGS. 4 and 5.

The elements of the dispensing unit are supported on a rectangular frame 32 having channel member legs 34 at the corners that are in turn supported over the bed in a spaced relationship to accommodate passage of the tray 10. The channel member legs 34 extend upward from the frame 32 and serve to removably support a lower drawer assembly 36 and an upper cup guide assembly 38 (FIG. 6). The assemblies 36 and 38 are supported on top of each other and are easily removed from the frame by lifting upward.

Generally, the cup guide assembly 38 provides a means to position and guide a plurality of rows and lines of upright stacked cups in a regular spaced array, and the drawer assembly 36 provides a means to vertically support each stacked group of cups while allowing an individual cup from each stack to be stripped and dropped downward into an empty tray.

In particular, the drawer assembly comprises a rectangular support made up of a pair of longitudinal members 40 connected at their ends by cross members 42. A pair of rollers 44 are rotatably mounted in a longitudinally spaced relationship on the outside side surface of each longitudinal member 40, said pairs of rollers being received in respective longitudinal track guides 46 having a channel shape to support and guide the rollers 44 and the associated frame in a linear reciprocable path. The track guides 46 are stationary, having their ends received in and supported by the upper extensions of the legs 34. The track guide channels also have stops 48 located at opposite ends of each channel.

The assembly described above thus provides a rectangular framework that may be moved back and forth longitudinally of the frame on the rollers moving in the track guides. In addition, a handle 47 (FIG. 6) may be provided at one end of the frame to facilitate moving the frame in a back and forth motion.

The drawer assembly 36 also includes a stripper bar sub-assembly carried within and secured to the frame defined by the members 40 and 42, said sub-assembly comprising a plurality of opposing pairs of stripper bars 50 held in a parallel relationship by means of notched transverse spacer members 52 and end retainers 54. The spacer members 52 may be exchanged for others to allow different spacing between opposed stripper bars 50, thus accommodating cups of various circumferential sizes. As will be explained below, the stripper bars move along with the drawer in a longitudinal linear path relative to the frame, causing individual cups to be stripped away and allowing them to fall by gravity into the awaiting receptacles of the underlying tray.

As shown, the cup guide assembly 38 comprises a plurality of transverse bars 56 supported in a spaced parallel relationship by a plurality of parallel longitudinal members 58, which together form a framework in the form of a grid having a plurality of rectangular openings. A plurality of vertical rods 60 are secured to the transverse bars 56 in a spaced relationship such that a rod is positioned in each of the four corners of each of the rectangular openings in the grid. The rods 60 extend both above and below the grid framework to guide and support cups that are stacked into each of the defined rectangular spaces. The lower portion of the rods 60 is of reduced cross section to support the cups during the stripping operation while allowing them to drop through the stripper bars 50. The ends of the longitudinal members 58 of the grid framework are supported in the upper extension of the legs 34, such that the cup guide assembly 38 is supported upon the drawer assembly 36.

Figure 4:
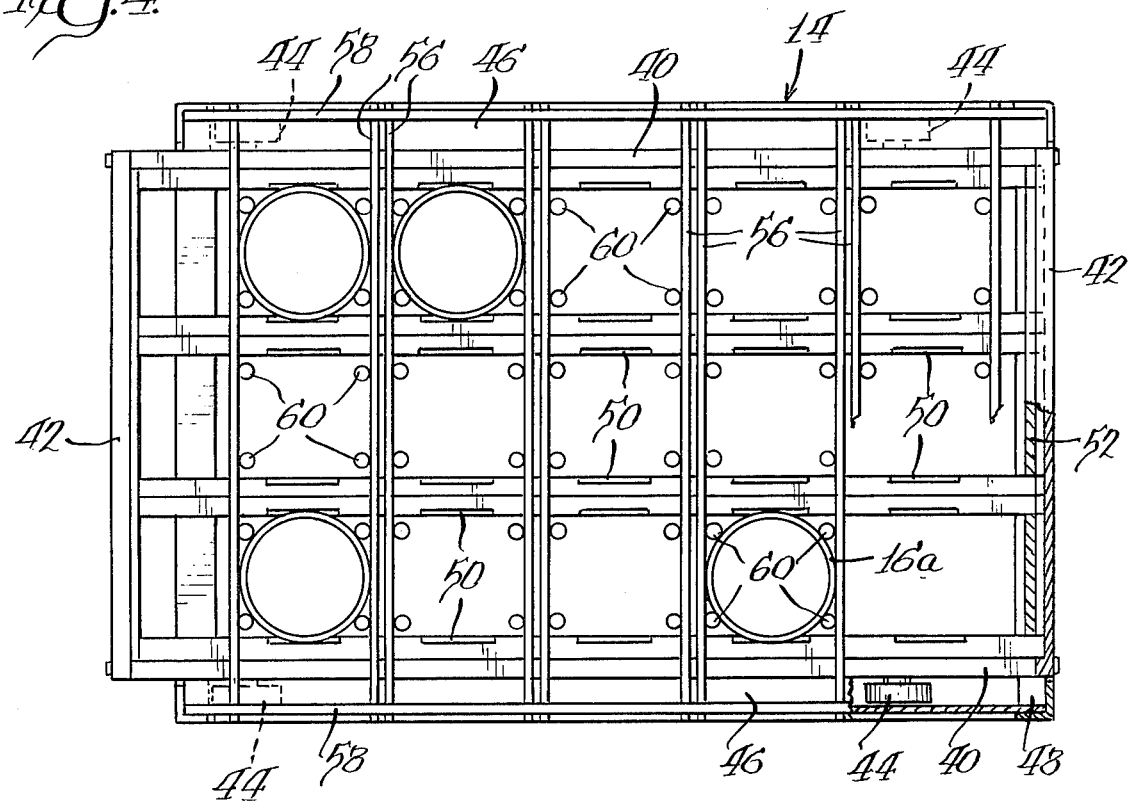
FIG. 4 is a plan view, partly in section of the cup dispensing device of the present invention.

Each rectangular group of four guide rods 60, as defined above, form a guide for a stacked group of upright cups, one of which, for example, is shown in outline at 16*a* in FIG. 4; in addition, each group of rods extends downward between adjacent pairs of stripper bars, whereby the lowermost cup in each stack is supported on the top of the stripper bars.

As best shown in FIGS. 4, 6, 7 and 8, corresponding opposed pairs of stripper bars 50 have opposed recessed areas 62 therein which serve to separate the lowermost cup of each stack from the upper cups, allowing the lowermost cup to drop downward. For the sake of brevity, only that portion of the device applicable to one stack of cups will be described, although it will be noted that the presently described apparatus will accommodate 15 separate stacks, and the apparatus may be modified to accommodate more or less.

Figure 7:
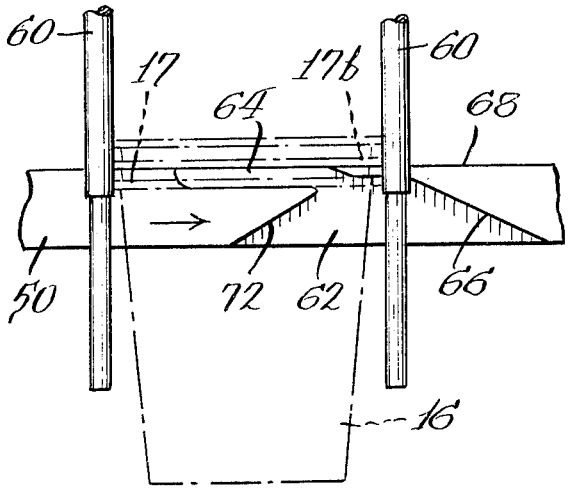
FIGS. 7 and 8 are detailed views of the cup stripping portion of the device shown in FIGS. 4 through 6.
Figure 8:
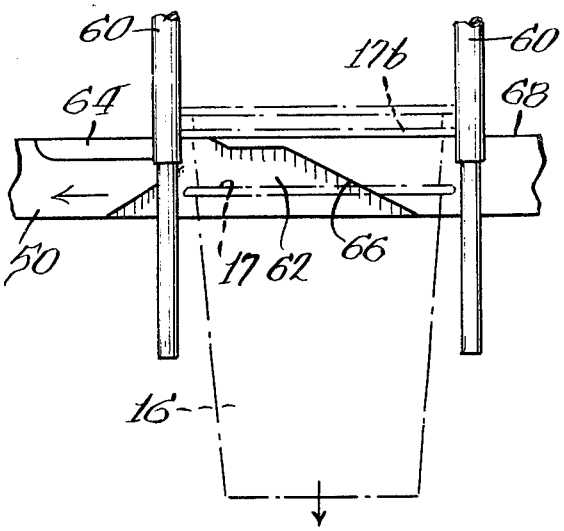

As shown in FIGS. 6 and 7, it may be seen that the combination of the four rods 60 and an opposed pair of stripper bars 50 from a rectangular passage through which the cups may pass. The distance between the unrecessed area of the stripper bars 50 is slightly less than the maximum outside diameter of the cup at the rim. The distance between the opposed recessed areas 62, however, is slightly greater than the maximum outside diameter of the cup at the rim. As shown in FIGS. 7 and 8, the recessed areas are each formed in the upper and inside surface of the bar and extend downward to form a rectangular recess 64 having a height that is slightly greater than the thickness of a cup rim, said height preferably corresponding to or slightly less than the stacking height of the cup being dispensed and the next adjacent cup. One end of the rectangular recess 64 merges into a downwardly flared recess 66 in the side of the bar, said recess extending entirely to the bottom edge of the stripper bar.

FIG. 7 shows the configuration of a stripper bar 50 that has been moved to a cup receiving position. In this position, the rectangular recess 64 is located midway between the restraining rods 60 and is in position to receive the rim 17 of the single lowermost cup 16. The drawer assembly has been moved to the maximum extent in the direction of the arrow, as determined by the position of the limit blocks 48 at one end of the track guide 46. In such position, it may be seen that the rim of the next adjacent cup 17*b* is spaced above the lowermost rim and slightly above the upper surface 68 of the bar 50 due to the inherent spacing between the cups in a stacked relationship, which is referred to herein as the stacking height between adjacent cups.

In order to eject a single cup, the drawer assembly and stripper bars are pushed longitudinally rearward, or in the direction of the arrow in FIG. 8. In so doing, the rim of the lowermost cup, being restrained by the rods 60 from longitudinal movement, drops or moves from the rectangular recess 64 into the enlarged or flared recess 66, which enables the cup to drop downward while the vertical path thereof is still being guided by the vertical rods 60. At the same time, the upper recess 64 is moved out of cup engaging position such that the rim of the next cup 17*b* is retained and supported upon an unrecessed upper surface 68 of the bar. When the bar is returned to its original position in FIG. 7, the rim of cup 17 will be allowed to enter the opposed recesses 64 in preparation for another stripping operation.

Preferably, the outline of the lower recessed area 66 is in the form of a trapezoid as shown in FIGS. 7 and 8, with the top thereof located below the top surface of the stripper bar 50 although merging with the lower forward portion of the upper recess 64, and the bottom thereof extending entirely to the bottom of the stripper bar. Upon movement of the stripper bar to the left as shown in FIG. 8, the area 66 presents a downwardly moving ramp surface that is effective to push the rim 17 of the lowermost cup downward, causing it to separate from the next adjacent cup. Upon return of the bar, as shown in FIG. 7, the other side of the trapezoid presents a second downwardly inclined ramp surface 72 that serves to disengage the rim of the cup if not entirely separated by the initial stroke.

From the foregoing, it will be seen that a single back and forth stroke of the drawer assembly 36 will be effective to discharge a plurality of single cups into the spaced pockets of a tray, whereupon the cups may be filled and capped as hereafter described.

Figure 9:
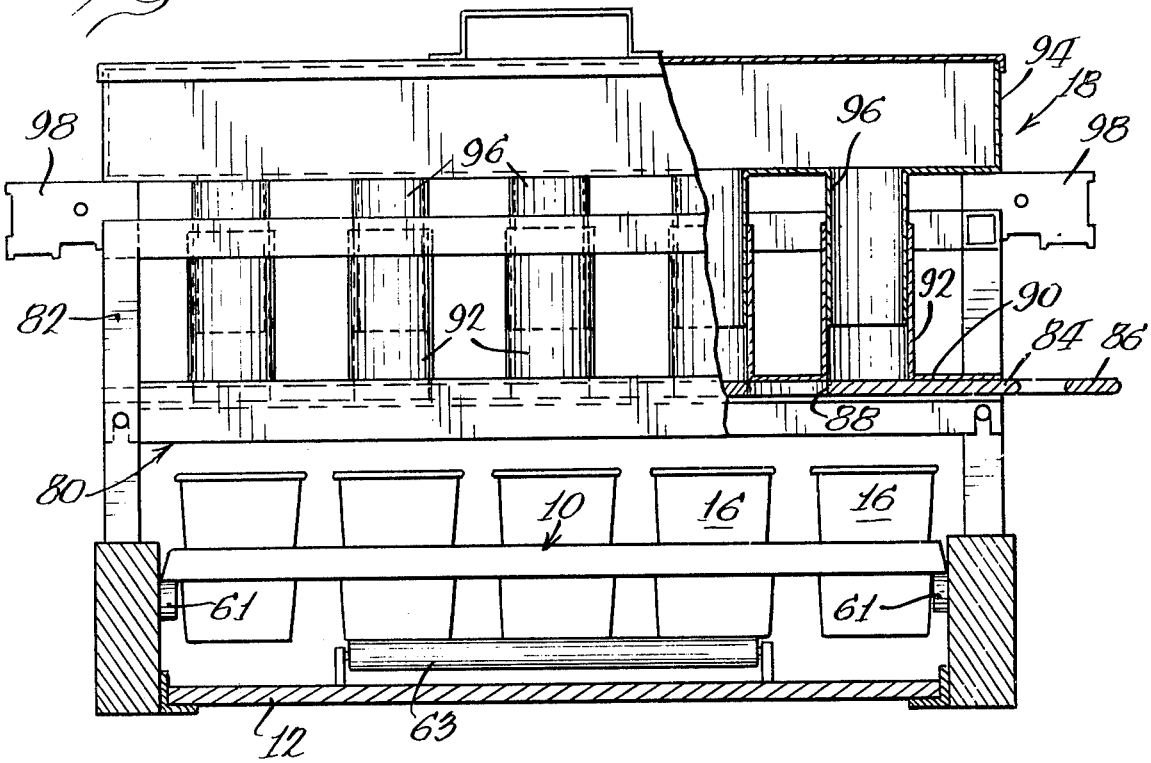
FIG. 9 is an elevational view, partly in section, of the ice dispensing device of the present invention.

As shown in FIG. 1, after the cups 16 have been dispensed into the tray 10, the tray is moved along the bed 12 to a position beneath the ice dispenser 18 shown in detail in FIG. 9.

The ice dispenser 18 again comprises a rectangular frame 80 having legs 82 at the corners to support the dispenser in a spaced relationship over the bed. Mounted at the bottom of the frame is a slide 84 having a handle extension 86 at one end and a plurality of vertical holes 88 therein through which the ice may alternatively pass or be blocked as determined by the position of the slide. Supported above the slide 84 is a bed 90 having a plurality of open upstanding or vertical tubes 92 mounted therein, said tubes corresponding to and in register with the holes in the slide when in dispensing position.

Mounted at the top of the ice dispenser is a large receptacle 94 for holding ice, said receptacle having a number of open vertical tubes 96 extending downwardly therefrom and being received in the respective lower tubes 92 in an adjustable telescoping relationship. The distance between the top edge of the upper tubes 96 and the bottom edge of the lower tubes 92 thus define an adjustable volumetric capacity for ice to be discharged into the respective cups, as determined by the degree of telescoping between the tubes.

Means are provided to adjust the distance between the receptacle 94 and the frame 80 to thereby allow adjustment of the volume of the respective tube pairs. For this purpose, an adjustable or graduated stop 98 is provided at each end of the dispenser extending between the receptacle and the frame.

In order to use the ice dispenser, the slide 84 is first moved to a position to block off the lower tubes 92, it being understood that the spacing between adjacent rows of holes 88 is greater than the diameter of the holes. A tray containing empty cups corresponding to the spacing of the tubes 92 is placed beneath the dispenser. Sufficient cubed or crushed ice is placed in the chamber to fill the space in the tubes 92–96. The slide 84 is then shifted to align the holes 88 therein with the tubes 92, which allows ice to fall downward into the subjacent cups 16 held by tray 10.

It will be appreciated that the ice dispenser 18 is optional and may be eliminated if uniced beverages, such as beer, coffee, tea, or other liquids and the like are to be filled into the cups. The ice dispenser may be used in lieu of the liquid dispenser to fill semisolids such as yogurt, custard and the like.

Figure 5:
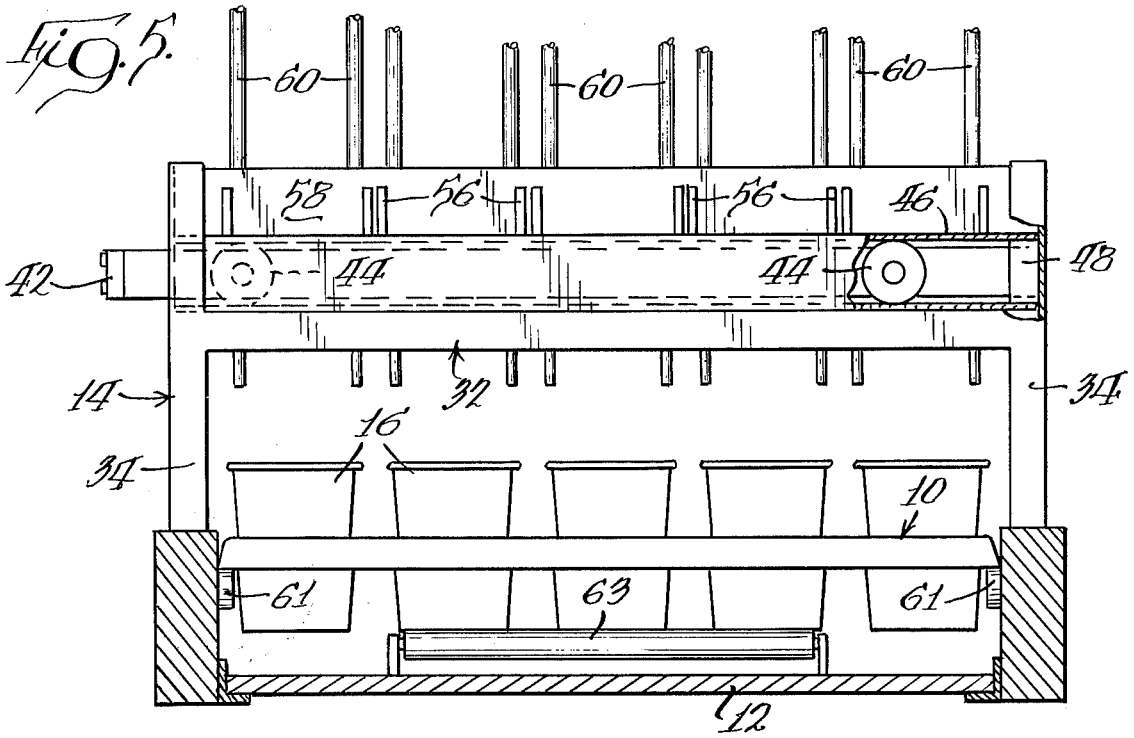
FIG. 5 is an end view, partly in section, of the device shown in FIG. 4.

As shown in FIGS. 5 and 9, the cup dispensing and ice dispensing devices may include bottom roller rods 63 to support the bottom of the tray during its passage beneath each device, as well as opposed side rollers 61 to support the side flanges 30 of the tray 10.

The capping device 22 and modifications thereof are shown in FIGS. 10 through 14. The device 22 comprises a pair of spaced side frames 100 supported on the bed 12, said frames having an upstanding portion 102 at the entrance and thereof. A plurality of inclined rods 104 are supported by suitable means across frame portions 102, said rods extending upward on an angle in a parallel relationship, with adjacent rods being spaced to receive a stack of lids 108 (FIG. 12) to be dispensed. Lid stops 106 are provided near the base of the rods and retain the lowermost lid until it is stripped, said stops being downwardly inclined members having a central recess 107, the edges of which recess engage the lowermost lid until the same is stripped as hereafter defined.

A rotary shaft 110 is positioned between the side frames 100, said shaft being carried at each end in a bearing 111 mounted for adjustment in an inclined slot 112 in each frame. An adjustable threaded member 114 is connected to each bearing to enable vertical adjustment of the shaft.

A plurality of radially extending fingers 116 are mounted in a spaced relationship on shaft 110, said fingers corresponding in number to the number of stacks of lids 108 to be dispensed. One end of the shaft 110 is connected to a manual crank 118 for rotating the shaft. Upon rotation, the fingers 116 are so positioned as to engage the downwardly turned flange on the lowermost lid of each stack, thereby stripping off a single lid from each stack.

Figure 12:
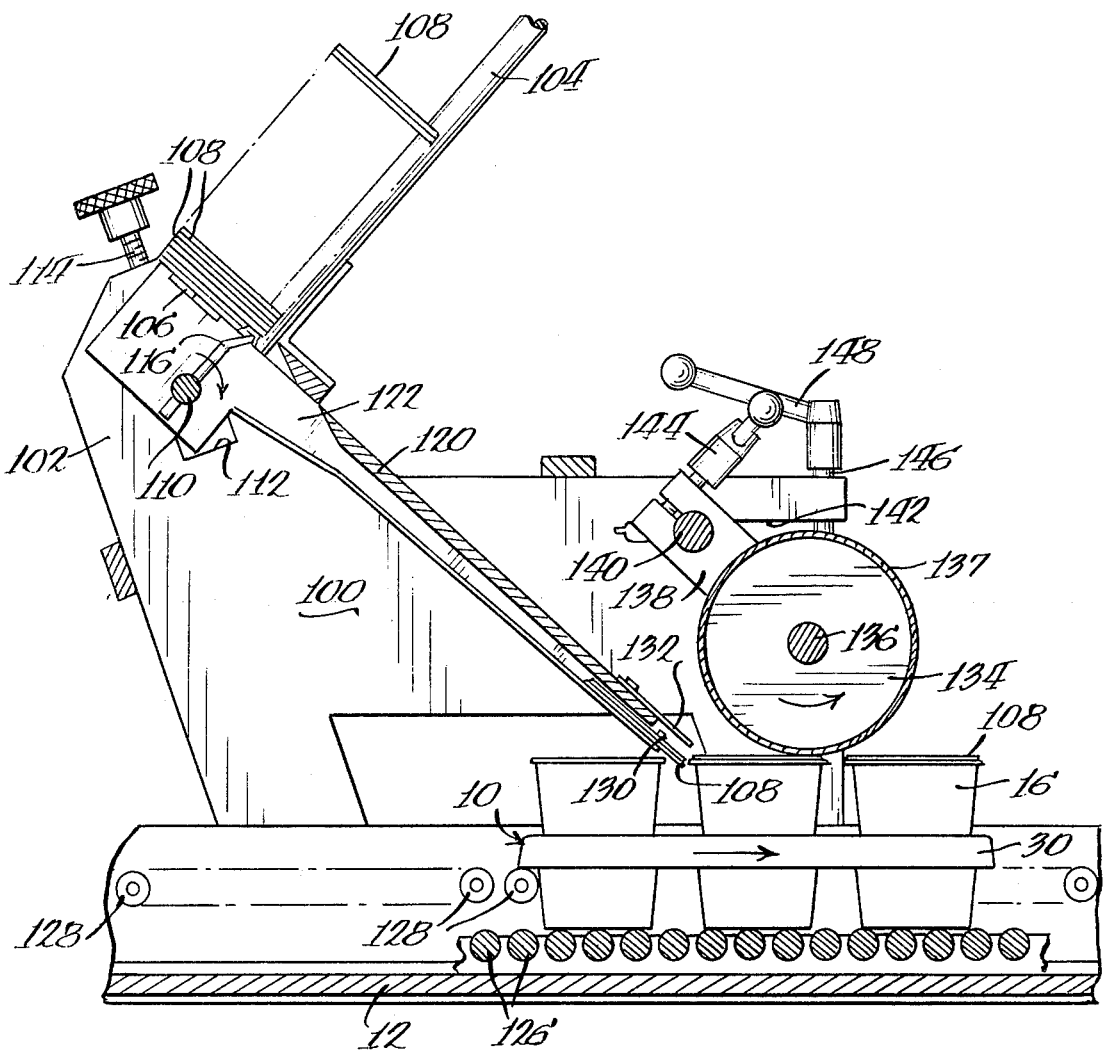
FIG. 12 is a vertical sectional view of the device shown in FIGS. 10 and 11.

A plurality of downwardly inclined chutes 120 are rotatably mounted on, and supported by the shaft 110, said chutes again corresponding to and arranged beneath the respective stacks of lids to be dispensed. As shown in FIG. 12, the upper portion 122 of each chute is enlarged to receive a single cap or lid 108 and tapers into a lower, elongate linear enclosed pathway, whereby a stripped lid slides down therein by gravity. The chutes 120 are connected in parallel and the downward angle thereof is adjustable by means of a thumb screw 124 in the outermost end chutes (FIG. 12), said screw bearing against the side frame 100 and being positionable in various apertures provided in the chute as determined by the desired angle of dependence from the shaft 110, in order to accommodate various heights of cups.

The lower end of each chute 120 terminates in a position spaced slightly above the respective lines of filled cups 16 carried thereunder in the tray 10. The tray 10 is supported at this stage on a plurality of transverse rotatable rods 126 rotatably supported above the bed 12 and serving to movably support the bottom of the tray. In addition, a plurality of side rollers 128 are provided to support the side flanges 30 of the tray.

The lower end or outlet of each chute 120 is provided with a pair of transversely spaced pins 130, the distance therebetween being slightly less than the diameter of the cup lid. The pins 130 are located at the outlet of the chute 120 such that a lid 108 will be temporarily retained and centered by the pins, while a portion of the lid will project on a downward angle beyond the end of the chute. The lid 108 projects to an extent such that the downwardly turned peripheral flange thereof will engage on or hook over the upper rim of the cup passing thereunder. The engagement between the lid 108 and the cup 16 is sufficient to strip the lid upwardly from the retainer pins 130 and allow the lid to be loosely deposited on the top rim of the cup. In addition, a flexible flap 132 extends downward from the outlet end of the chute, the end of said flap gently wiping over the deposited lid as the lid is being deposited on the cup, thereby assuring that the lid will be accurately deposited and positioned horizontally on the cup rim.

Means are also provided to press the loosely deposited lids 108 into firm or locking engagement with the cup rim. A transverse roller 134 (or a plurality of individual rollers) are rotatably mounted on a shaft 136 immediately beyond the outlet of the chute 120, said roller preferably having a resilient cover 137, to avoid distortion of the filled cups. As will be hereinafter explained, the roller 134 is positioned so as to engage and press downwardly against the loosely lidded cups as the tray 10 is being drawn between the roller 134 and the lower rotary support elements 126 and 128, whereby the lids 108 are compressed onto the tops of the cups 16. It will be understood that the lids 108 employed herein are of a conventional type that are capable of resiliently locking on or embracing around the top edge or rim of the cup when compressed thereon.

The shift 136 is adjustably mounted between the side frames 100 so as to allow vertical adjustment of the roller 134. The ends of shaft 136 are journalled in arms 138, the other ends of which are secured around rod 140 by means of a handle 144. Rod 140 is adjustable in slot 142 and is secured in place by handle 148. Means are provided for clamping the rod 140 and hence the roller 134 is a given vertical position. In the embodiment shown, the slot 142 extends to the end of the frame, and a threaded member 146 having a handle 148 secured thereon passes through the slot and side frame, whereby the threaded member can be tightened to reduce the width of the slot and clamp the shaft 136 therein, while also allowing the position of the roller 134 to be adjusted longitudinally.

Figure 10:
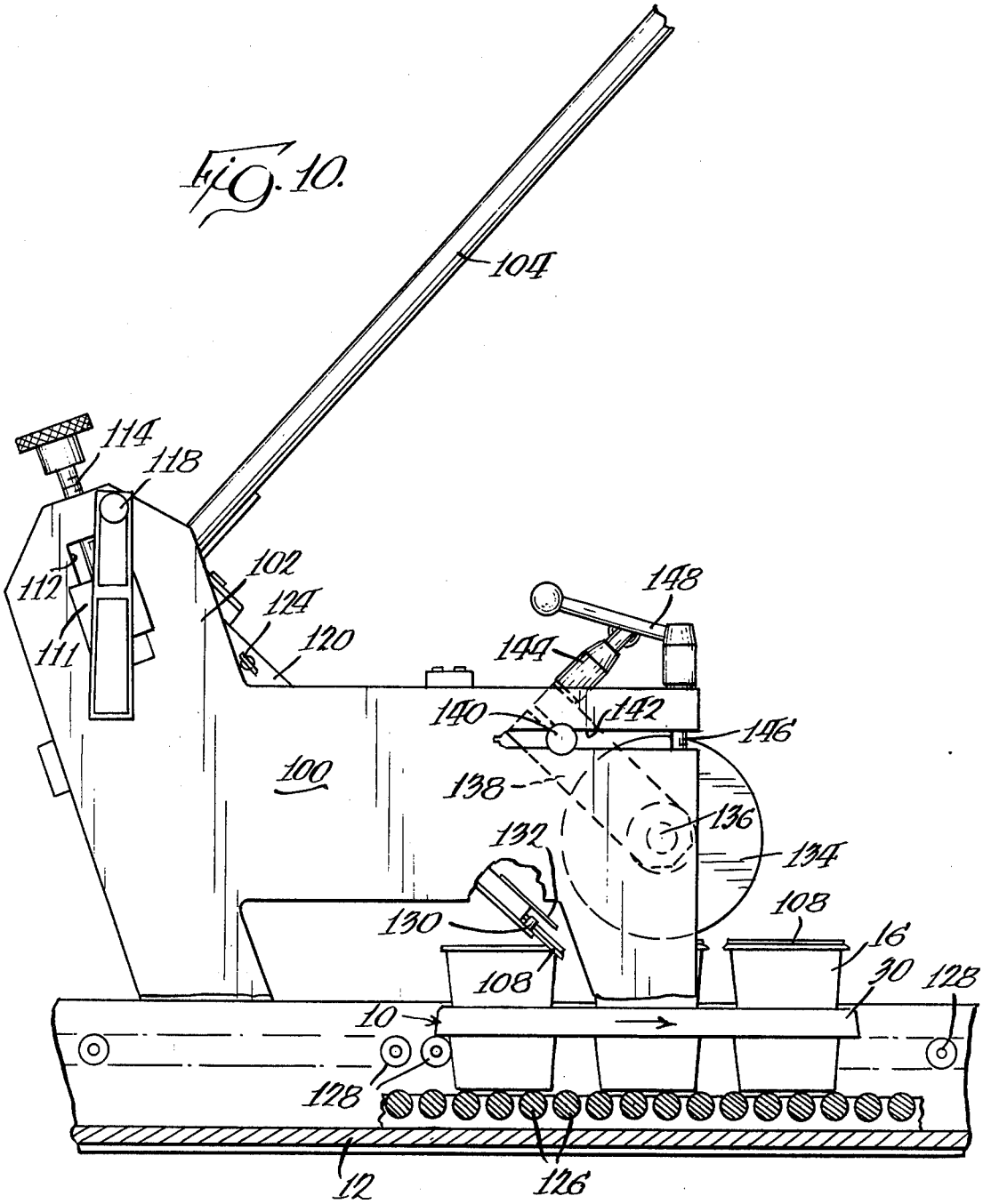
FIG. 10 is an elevational view, partly in section, of the cup capping device of the present invention.
Figure 11:
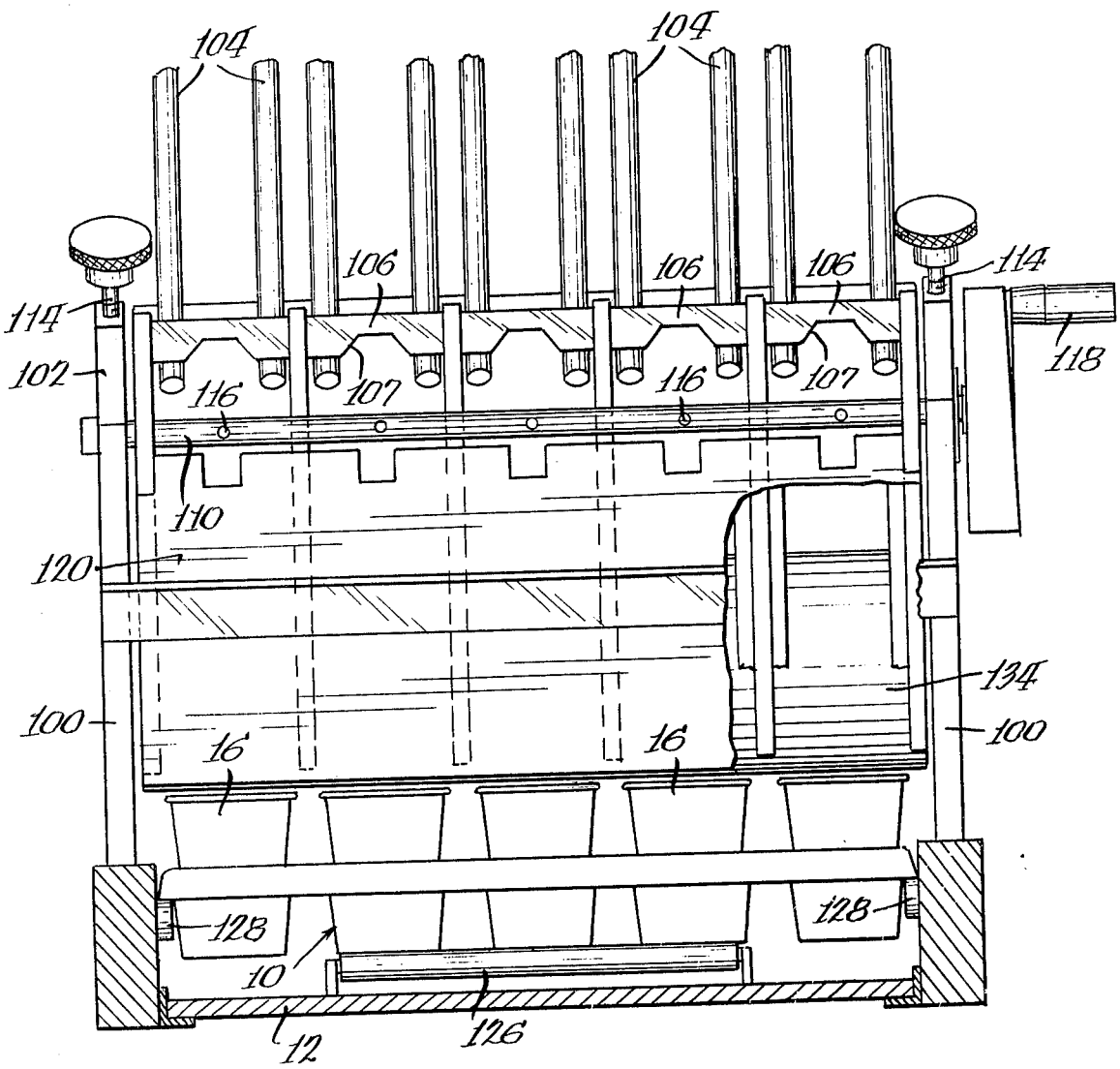
FIG. 11 is an end view, partly in section of the device shown in FIG. 10.

In the operation of the capping device shown in FIGS. 10 - 12, stacks of lids 108 are placed on the rods 104 and are supported by the retainers 106. The handle 118 is then rotated for a given number of turns, corresponding to the number of rows of lids to be dispensed. With each turn of the handle 118, the fingers 116 engage the forward inner surface of the rims of a row of lids, stripping the lids away from the retainers 106 and into the chute 120. The chutes 120 are sufficiently elongate to accommodate the total number of lids to be dispensed for a given tray, and at this stage, a series of lids will be available in each chute in a circumferentially stacked relationship.

With the capping device in readiness, as described above, the tray 10 is drawn or pushed beneath the capping device in the direction of the arrow in FIG. 12. The ends of the chutes 120 are disposed such that the rim of the cap 108 will engage over the rim of the cup 16, with the result that the cap will be released from the pins 130 and allow a new cap to take its place. Shortly after the lid is hooked by the rim of the cup, the flap 132 engages downwardly on the cap, causing it to be loosely deposited in a centered position on the cup rim. Upon continued passage of the cup beneath the roller 134, the cap is firmly compressed onto the cup into sealing engagement therewith.

During the capping procedure, it will be noted that the tray 10 is supported on the lower roller rods 126 and the side rollers 128 to facilitate and accurately guide movement of the tray through the capping device, particularly since alignment of the caps is critical and since downward pressure is being exerted on the individual cups. The tray 10, in turn, serves the important function of holding the cups upright in proper alignment and preventing them from tilting under the exertion of the compression roller 134.

Figure 13:
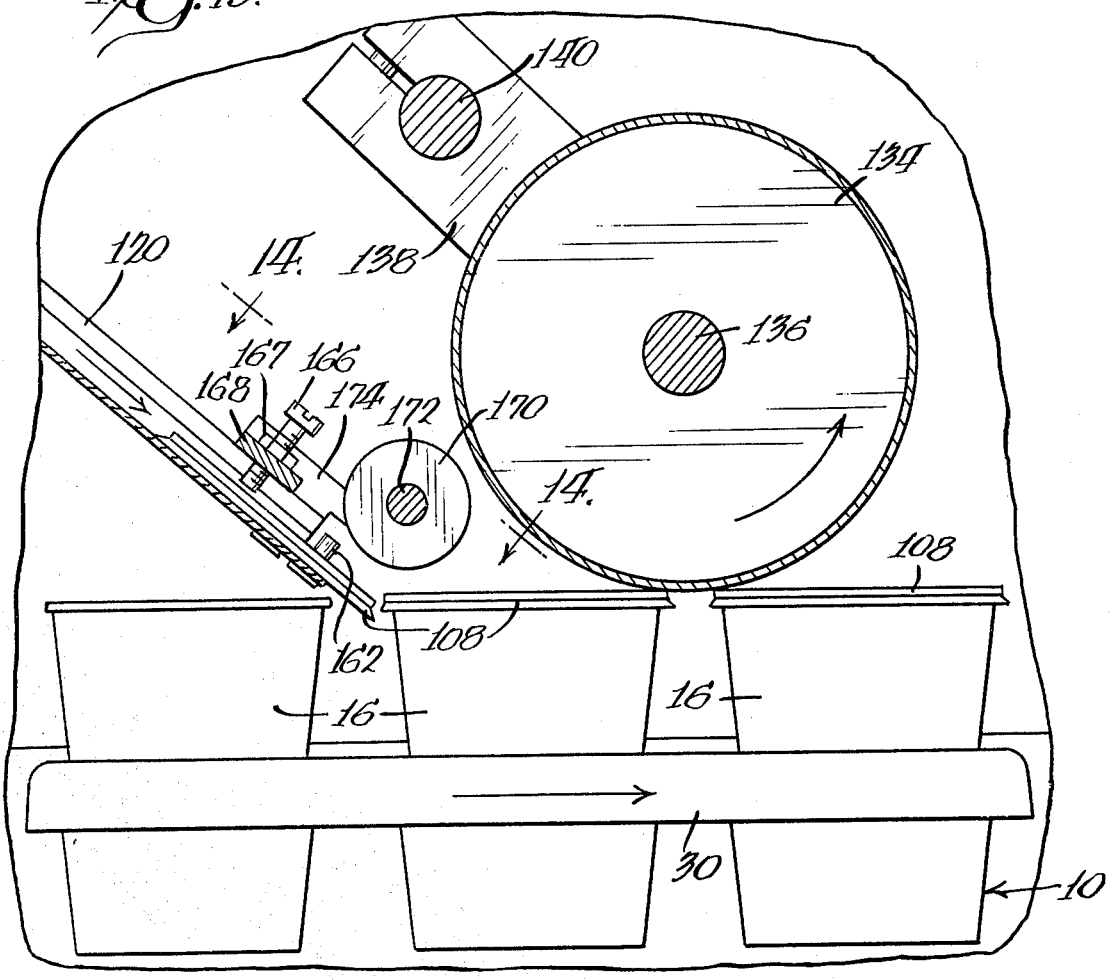
FIG. 13 is a fragmentary view of an alternate cup applying mechanism.
Figure 14:
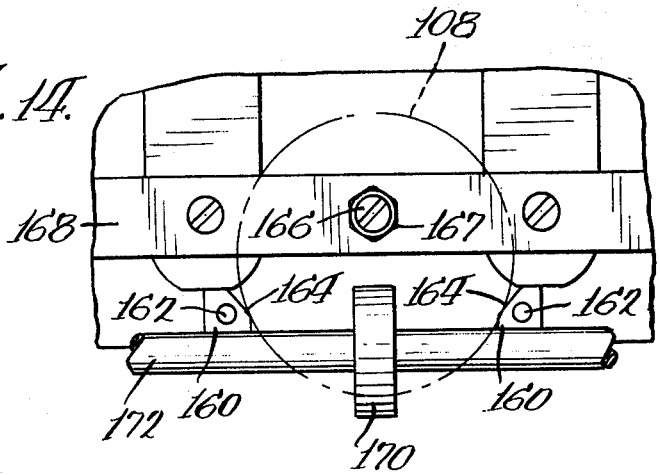
FIG. 14 is a plan view of the mechanism shown in FIG. 13.

A further embodiment of the capping device is shown in FIGS. 13 and 14, which illustrates an improved version of the cap application portion of the previously described embodiment. The other parts of the present embodiment are identical to the parts previously described and will be given the same reference numerals.

In accordance with the present embodiment, the end of each chute 120 terminates in an opposed pair of inwardly inclined stop blocks 160 secured at the opposite sides of each chute. As shown in FIG. 14, the stop blocks 160 serve to retain and center individual lids as they reach the bottom end of the chutes while allowing the lid to overhang from the chute as previously described. In addition, a pair of upright pins 162 is mounted on top of the respective blocks 160. The pins 162 are spaced slightly outward from the inner side surfaces 164 of the blocks that initially engage and center the cap 108. The spacing between the facing surface of the pins 162 is slightly less than the diameter of the lid 108. As the lid 108 is engaged and drawn away by an underlying cup rim, as shown in FIG. 13, the lid rides up over the blocks 160 and engages between the pins 162, which in turn exert a slight longitudinal tension on the lid while keeping the lid centered over the cup.

As shown, a tension screw 166 is adjustably mounted through a cross member 168 centrally near the end of each chute 120. The tension screw 166 is mounted rearwardly of the blocks 160 and is adjusted to slidably engage the lid being removed, said screw being locked in place with lock nut 167. The tension screw 166 serves to exert additional slight adjustable tension along the center line of the upper side of the lid and also prevents the rearward portion thereof from tilting upward, particularly upon engagement of the free end of the lid with the cup.

The flexible flap 132 of the previous embodiment is replaced in the present embodiment by a rotatable tension roller 170 mounted slightly beyond the end of the chute 120 on a fixed transverse shaft 172 held by a suitable bracket 174 or the like. The roller 170 is positioned and sized to rotate parallel with the centerline of the emerging lid and to engage the central portion of the lid as it moves between the end of the chute 120 and the compression roll 134. The roller exerts slight downward and rearward tension on the lid passing thereunder and together with the stop blocks 160 and pins 162, prevents disengagement between the forward portion of the lid and the corresponding portion of the rim of the cup, thereby allowing the lid to be centered on the cup.

We claim:

1. In conjunction with apparatus for dispensing, filling, and capping a plurality of cups, a capping means comprising cap support means for supporting a stack of nested caps, an elongated downwardly inclined chute beneath said cap support means, means for ejecting single caps from said cap support means onto said chute, and restraining means at the lower end of the chute for restraining the cap at the end of the chute with the end of the cap projecting beyond the chute on a downwardly inclined angle, the rim of a cup passing beneath said chute engaging said cap to remove said cap from said restraining means and allowing the cap to drop onto the cup, said restraining means comprising a first pair of spaced members at the end of the chute, the distance between said members being less than the diameter of the cap, and a second pair of spaced members mounted on the respective first pair of members, said second members having a spacing greater than that between said first members but less than the diameter of the cap.

2. In conjunction with apparatus for dispensing, filling, and capping a plurality of cups, a capping means comprising cap support means for supporting a stack of nested caps, an elongated downwardly inclined chute beneath said cap support means, means for ejecting single caps from said cap support means onto said chute, restraining means at the lower end of the chute for restraining the cap at the end of the chute with the end of the cap projecting beyond the chute on a downwardly inclined angle, the rim of a cup passing beneath said chute engaging said cap to remove said cap from said restraining means and allowing the cap to drop onto the cup, and an adjustable member in said chute substantially perpendicular to the caps carried therein, said adjustable member being centrally located in the upper surface of said chute and being slidably engaged by the top surface of said cap when being removed from said restraining means.

3. In conjunction with apparatus for dispensing, filling and capping a plurality of cups, a capping means comprising cap support means for supporting a stack of nested rimmed caps, an elongated downwardly inclined chute beneath said cap support means, means for ejecting single caps from said cap support means onto said chute, and restraining means at the lower end of the chute for restraining the cap at the end of the chute with the end of the cap projecting beyond the chute on a downwardly inclined angle, the rim of a cup passing beneath said chute engaging said cap to remove said cap from said restraining means and allowing the cap to drop onto the cup, said means for ejecting single caps from said cap support means comprising a rotary shaft positioned between said cap support means and said chute, said cap support means supporting the lowermost of said caps at one side thereof, the other side of said lowermost cap projecting beyond said support means, and a member on said shaft engageable under the rim of said lowermost cap at said other side thereof to draw said cap away from said one side and into said chute.

4. The apparatus of claim 3 further comprising means to rotate said shaft.

5. In conjunction with apparatus for dispensing, filling and capping a plurality of cups, a capping means comprising cap support means for supporting a stack of nested caps, a downwardly inclined chute beneath said cap support means, means for ejecting a cap from said stack into said chute, restraining means at the lower end of the chute for restraining the cap at the end of the chute for loose pick up by the rim of a cup passing beneath the chute, means for supporting said cups against tipping while being capped, holding means for holding the loosely applied caps in centered position on said cups, said holding means comprising a flexible, sheet-like flap secured to and extending from the lower end of the chute, the free end thereof engagable with said caps and resilient rotatable roll means beyond said chute for compressing the loose cap onto said cup.

6. The apparatus of claim 5 wherein means are provided for adjusting said rotatable roll means in various horizontal positions to accommodate cups of various heights.

7. The apparatus of claim 5 wherein said means for applying caps loosely onto said cups and means for compressing said caps downwardly on said cup are connected and form a common unit, and means are provided for adjusting the distance therebetween.

* * * * *